US005539932A

United States Patent [19]

Howard

[11] Patent Number: 5,539,932

[45] Date of Patent: Jul. 30, 1996

[54] ADJUSTABLE LENGTH GARMENT

[76] Inventor: Michael A. Howard, 64 Park End Pl., East Orange, N.J. 07018-1114

[21] Appl. No.: 492,843

[22] Filed: Jun. 2, 1995

[51] Int. Cl.[6] ..... A41D 27/10

[52] U.S. Cl. ..... 2/269; 2/227

[58] Field of Search ..... 2/269, 227, 912, 2/919; 24/446

[56] References Cited

U.S. PATENT DOCUMENTS

| | | | |
|---|---|---|---|
| 2,187,447 | 1/1940 | Chait et al. | 2/269 |
| 2,524,814 | 10/1950 | Leaf | 2/269 |
| 2,705,326 | 4/1955 | Lahnstein et al. | 2/269 |
| 4,149,275 | 1/1979 | Sanchez | 2/269 |
| 4,200,938 | 5/1980 | LeTourneau | 2/269 |
| 4,896,379 | 1/1990 | Kape | 2/269 |
| 4,985,936 | 1/1991 | Jones | 2/269 |
| 5,088,128 | 2/1992 | Kape | 2/269 |

*Primary Examiner*—Amy B. Vanatta
*Assistant Examiner*—Shirra L. Jenkins
*Attorney, Agent, or Firm*—Goldstein & Associates

[57] ABSTRACT

An adjustable length garment, for adjusting the length of a pant leg having an interior surface and a bottom edge, comprising an adjustment tab mounted to the interior surface near the bottom edge, and an adjustment array located above the adjustment tab on the interior surface. The adjustment array comprises a vertical strip having an inner seam and an outer seam along which the vertical strip is attached to the interior surface. The adjustment array also comprises fingers attached to the vertical strip along the inner seam, the fingers having type two fastener material. The adjustment tab has type two fastener material, and the vertical strip has type one fastener material for mating with the adjustment tab. The fingers can fold along the inner seam to affix to the vertical strip to cover exposed fastener material.

9 Claims, 2 Drawing Sheets

ADJUSTABLE LENGTH GARMENT

BACKGROUND OF THE INVENTION

The invention relates to an adjustable length garment. More particularly, the invention relates to a pair of pants that allows for quick and easy adjustment of its length without the need to sew or pin the garment.

Children grow rapidly. Thus, parents are constantly confronted with the need to either adjust hemlines or buy new clothes. Adjusting hemlines can be time consuming, and buying new clothes can be costly.

Adjusting a hemline generally involves cutting the current stitches, unfolding the cuff, resetting the cuff to a desired length, and then restitching the hem. Often an unsightly dirt or fade line is present at the bottom of the old cuff. When the hemline is lengthened, this line is visible on the outside of the pants, near the bottom. This line might be acceptable on a child's play clothes, but is probably not acceptable on the child's better clothing or dress clothing. In addition, stitch lines are often also visible from the old hems.

Buying new clothing is often the only option, especially when a hem has been repeatedly let down. However, since children grow so rapidly, this can be an expensive option. This is profoundly true for a parent with several children, each constantly requiring the purchase of new clothing.

U.S. Pat. No. 4,200,938 to LeTourneau discloses an adjustable pant leg system designed for use by formal clothing rental outlets. In LeTourneau, there is no provision for preventing the hook and loop material from clinging onto other clothing or the wearer's skin.

While these units may be suitable for the particular purpose employed, or for general use, they would not be as suitable for the purposes of the present invention as disclosed hereafter.

SUMMARY OF THE INVENTION

It is an object of the invention to produce an adjustable length garment, having an adjustment mechanism which allow the hem to be set to a variety of lengths without the need for sewing or pinning.

It is another object of the invention that the set length may be maintained with the strength and stability of a permanent hem, while still allowing quick and easy adjustment.

It is a further object of the invention that provision is made to protect the user and his clothes from becoming snagged or caught on the adjustment mechanism.

It is a still further object of the invention to provide and adjustable length garment that is suitable for use with children, who generally require frequent pant hem adjustment.

The invention is an adjustable length garment, for adjusting the length of a pant leg having an interior surface and a bottom edge, comprising an adjustment tab mounted to the interior surface near the bottom edge, and an adjustment array located above the adjustment tab on the interior surface. The adjustment array comprises a vertical strip having an inner seam and an outer seam along which the vertical strip is attached to the interior surface. The adjustment array also comprises fingers attached to the vertical strip along the inner seam, the fingers having type two fastener material. The adjustment tab has type two fastener material, and the vertical strip has type one fastener material for mating with the adjustment tab. The fingers can fold along the inner seam to affix to the vertical strip to cover exposed fastener material.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
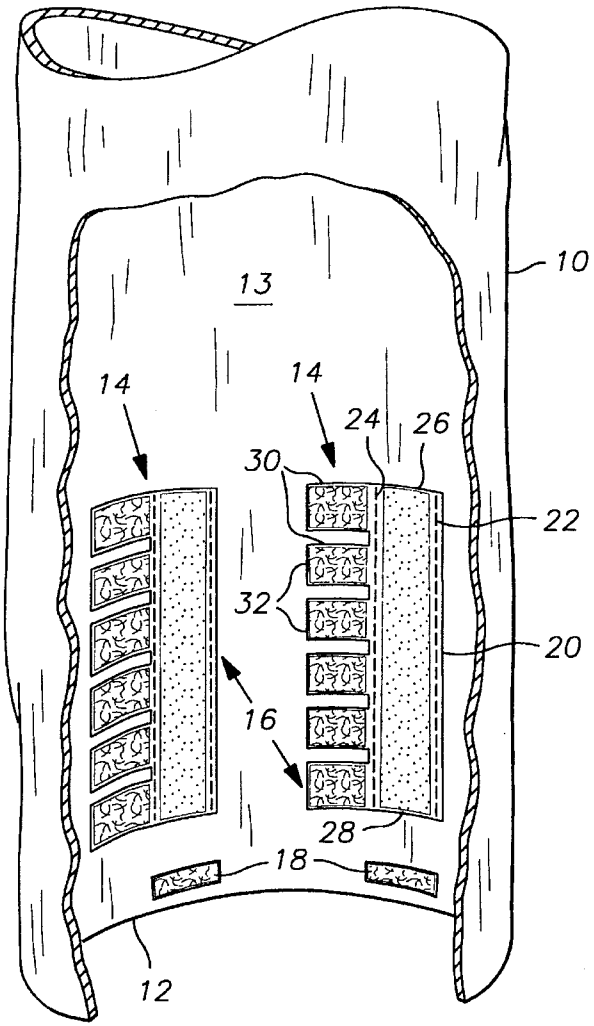
FIG. 1 is a diagrammatic perspective view, with parts broken away, illustrating a pant leg with the instant invention installed.

FIG. 1 illustrates a pant leg 10 having a bottom edge 12, and having an interior surface 13. Adjustment mechanisms 14 are mounted on the interior surface 13 for allowing adjustment of the length of the pant leg 10. The adjustment mechanism 14 comprises an adjustment array 16 and an adjustment tab 18. The adjustment array 16 is located toward the bottom edge 12, and the adjustment tab 18 is located near the bottom edge 12 closer to the bottom edge 12 than the adjustment array 16. The adjustment tab 18 is located directly below the adjustment array 16.

The adjustment array 16 and adjustment tab 18 are designed to mate with one another. In order to mate, the adjustment array 16 and adjustment tab 18 can contain hook and loop fastener components. At certain locations, it is imperative for either hook or loop to be present, since the opposite component is present at a mating location. Thus, from this point on, type one fasteners comprises either hook or loop components, and type two fasteners are the opposite of type one fasteners.

The adjustment array 16 comprises a vertical strip 20 located directly above the adjustment tab 18. The vertical strip 20 has an outer seam 22 and an inner seam 24. The adjustment array is stitched to the pant leg along the outer seam and inner seam 24. A vertical strip width is defined as the distance between the outer seam 22 and inner seam 24. The vertical strip also has a vertical strip top 26 and a vertical strip bottom 28. A vertical strip height is defined as the distance between the vertical strip bottom 28 and vertical strip top 26.

A plurality of fingers 30 adjoin the vertical strip 20 along the inner seam 24, each finger above the next along the entire vertical strip height. Each finger 30 has a finger end 32 which is not attached to the pant leg, but is only attached to the vertical strip 20 along the inner seam 24. Thus, each finger 30 is in effect hinged along the inner seam 24. A finger width for each finger 30 is defined as the distance between the inner seam 24 and the finger end 32. Preferably, the finger width is equal to the vertical strip width. Thus, each finger 30 may be folded about the inner seam 24 so that the finger 30 fully overlaps the vertical strip 20, with the finger end 32 coinciding with the outer seam 22.

Figure 2:
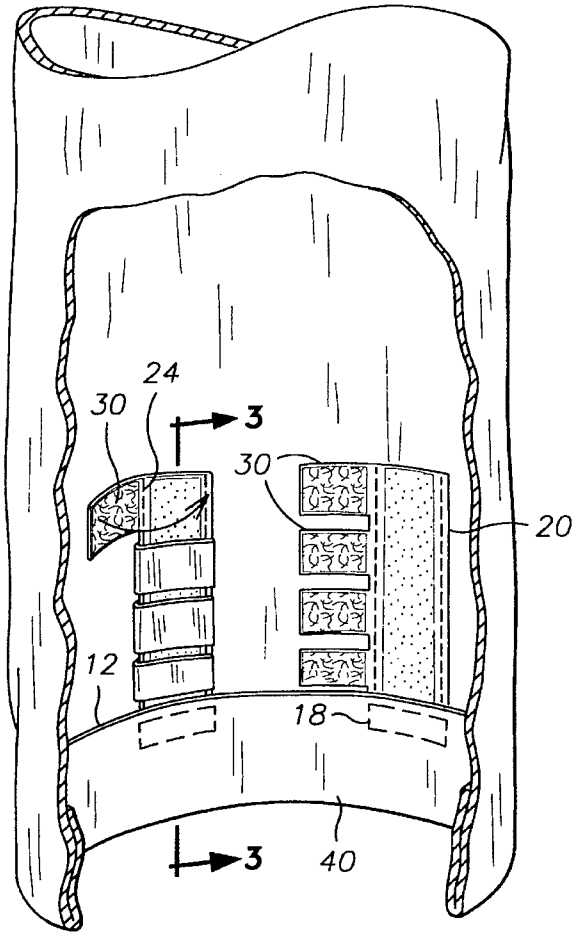
FIG. 2 is a diagrammatic perspective view, with parts broken away, illustrating the invention being used to adjust the length of the pant leg and then hold the adjusted position.

The adjustment array can contain several fingers 30, the purpose of which will become apparent when FIG. 2 is referred to hereinafter. Illustrated in FIG. 1, six fingers 30 are employed. Also illustrated in FIG. 1, two adjustment arrays and corresponding adjustment tabs 18 are shown. However, in reality two more adjustment arrays 16 and corresponding adjustment tabs 18 are located opposite the two shown, in the portion of the pant leg 10 that has been removed. An adjustment array 16 and adjustment tab 18 should be located opposite each adjustment array 16 and adjustment tab 18. Thus, if two are present, they would be located 180 degrees apart around the pant leg 10. In the illustrated embodiment, with four present, they are located approximately 90 degrees apart.

Type one fastener is attached on the vertical strip 20. Type two fastener is attached on the fingers 30. Thus, when the fingers are folded about the inner seam 24, the fingers 30 can adhere to the vertical strip. In addition, the adjustment tab 18 should have type two fastener. Thus, the adjustment tab 18 can adhere along any portion of the vertical strip 20.

Referring to FIG. 2, the pant leg has been folded under, bringing the bottom edge 12 up inside the pants, thus creating a cuff 40. The adjustment tab 18 has been inverted 180 degrees, and is thus inside the cuff 40, and now corresponds to the vertical strip 20, where it is fastened to maintain the cuff. Next, all fingers 30 above the cuff 40, (i.e. above the bottom edge 12) are folded about the inner seam 24 to mate the type one and type two fastener material, so that the fingers adhere to the vertical strip 20. Thus, all exposed type one and type two fastener material is covered and cannot snare other clothing, socks, or the skin of a person wearing the garment.

Figure 3:
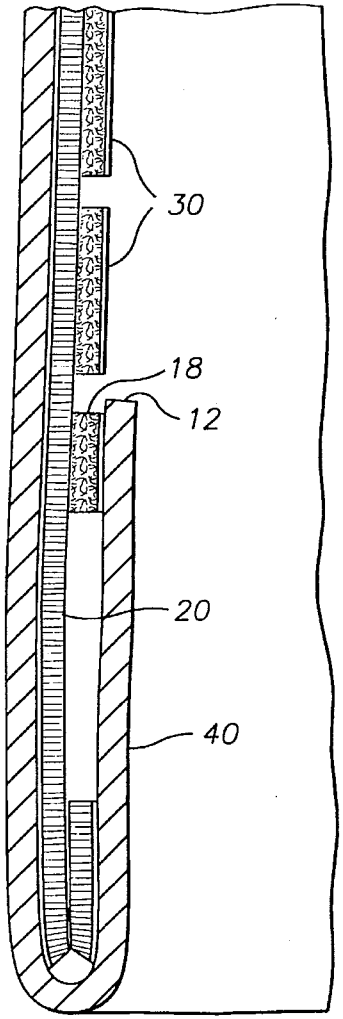
FIG. 3 is an enlarged cross sectional view, taken along line 3—3 in FIG. 2, showing the adjustment mechanism.

Referring to FIG. 3, the cuff 40 has been formed, and is held in place by the adjustment tab 18 adhering to the vertical strip 20. The fingers 30 above the bottom edge 12 have been folded, and are also adhering to the vertical strip 20.

When it is necessary to adjust the length of the pant leg 10, the adjustment tab 18 may be pulled away from the adjustment array 16. Then, the fingers 30 are peeled from the vertical strip 20. Next, the bottom edge 12 is folded up into the pant leg 10 to establish a new cuff. The adjustment tab 18 is pressed against the vertical strip 20 to hold the cuff. Finally, the fingers 30 above the bottom edge 12 are folded to adhere the fingers 30 to the vertical strip 20.

With frequent adjustments of the hem, it is unlikely that unsightly lines will develop from previous cuffs. However, it is recommended that the user uncuff the pant leg prior to washing the garment, to avoid establishing fade or dirt lines at the bottom of the cuff. It should be noted that this practice would not be possible or practical with a normal sewn hem.

Thus, herein is described a system for adjusting the length of a garment quickly and easily, without the need for sewing or pinning.

What is claimed is:

1. An adjustable length garment system for adjusting the length of a garment having a pant leg, the pant leg having a bottom edge and an interior surface, using type one and type two fastener components which mate with one another, comprising:

a) an adjustment tab, located on the interior surface near the bottom edge, having type two fastener; and b) an adjustment array, comprising:

i) a vertical strip having an inner seam, an outer seam, and having type one fastener, the vertical strip attached to the interior surface along the inner seam and outer seam, the vertical strip directly above the adjustment tab, and ii) at least two fingers extending from the inner seam having type two fastener.

2. The adjustable length garment as recited in claim 1, having two or more adjustment tabs, and two or more adjustment arrays.

3. The adjustable length garment as recited in claim 1, wherein the vertical strip has a vertical strip width defined as the distance between the inner seam and outer seam, the fingers each have a finger end, a finger width is defined as the distance between the inner seam and finger end, and the finger width is substantially equal to the vertical strip width, so that each of the fingers may be folded along the inner seam until the finger end coincides with the outer seam and the type one fastener on the vertical strip mates with the type two fastener on the fingers.

4. The adjustable length garment as recited in claim 3, having four or more adjustment arrays and four or more adjustment tabs.

5. The adjustable length garment as recited in claim 4, wherein each adjustment array has six fingers.

6. The adjustable length garment as recited in claim 4, wherein the vertical strip has a vertical strip top and a vertical strip bottom, a vertical strip height is defined as the distance between the vertical strip top and vertical strip bottom, and each of the fingers is located above the next along the vertical strip height.

7. An adjustable length garment method, for adjusting the length of a garment having a pant leg having a bottom edge and an interior surface, using an adjustment tab having type two fastener attached to the interior surface near the bottom edge and a vertical strip above the adjustment tab, the vertical seam having type one fastener and having an inner seam and an outer seam that are stitched to the interior surface, fingers are attached to the vertical strip along the inner seam, comprising the steps of:

a) cuffing the pant leg by folding the pant leg under, bringing the bottom edge upward inside the pant leg;

b) setting the cuff by affixing the adjustment tab to the vertical strip; and c) covering exposed fastener material by folding the fingers above the bottom edge so that they cover the vertical strip above the bottom edge.

8. The adjustable length garment of claim 7, wherein the fingers contain type two fastener, and the step of folding the fingers above the bottom edge further comprises mating the type two fastener on the fingers with the type one fastener on the vertical strip.

9. The adjustable length garment method of claim 8, wherein the method further comprises the steps of:

d) pulling the adjustment tab away from the vertical strip;

e) uncuffing the pant leg;

f) peeling the fingers from the vertical strip; and g) repeating previously recited steps a through c.

* * * * *